US005118553A

United States Patent [19]

Boisson

[11] Patent Number: 5,118,553

[45] Date of Patent: Jun. 2, 1992

[54] DECORATIVE BED COVERING

[76] Inventor: Judi Boisson, 96 Main Street, Southampton, N.Y. 11968

[21] Appl. No.: 653,782

[22] Filed: Jan. 28, 1991

[51] Int. Cl.[5] ..... B32B 3/06

[52] U.S. Cl. ..... 428/99; 428/57; 428/58; 428/195; 428/100; 5/482; 5/486; 5/487; 5/488; 5/495; 5/502; 24/381; 24/442

[58] Field of Search ..... 428/99, 100, 57, 58, 428/195; 5/486, 495, 496. 498, 487, 482, 488, 501, 502; 24/381, 442

[56] References Cited

U.S. PATENT DOCUMENTS

| | | | |
|---|---|---|---|
| 1,267,042 | 5/1918 | Arnold | 5/486 |
| 2,736,043 | 2/1956 | Temple | 5/502 |
| 2,799,870 | 7/1957 | Sullivan | 5/495 |
| 2,810,921 | 10/1957 | Seidenberg | 5/501 |
| 3,273,176 | 9/1966 | Millar | 5/486 |
| 3,331,088 | 7/1967 | Marquette | 5/486 |
| 3,508,285 | 4/1970 | Marquette | 5/486 |
| 3,795,019 | 5/1974 | Fragas | 5/486 |
| 4,680,821 | 7/1987 | Maguire | 5/496 |
| 4,815,156 | 3/1989 | Williams | 5/496 |

FOREIGN PATENT DOCUMENTS

| | | | |
|---|---|---|---|
| 2483760 | 12/1981 | France | 5/486 |

*Primary Examiner*—Ellis P. Robinson
*Assistant Examiner*—Nasser Ahmad
*Attorney, Agent, or Firm*—Howard F. Mandelbaum

[57] ABSTRACT

A bed covering has connectable panels which are connected at overlapping borders by complementary fasteners. When used to make up a bed, one panel can be hidden by the bed's blanket while the other is folded over the upper portion of the blanket, or the foregoing appearance can be simulated, to provide an aesthetically pleasing visible effect.

11 Claims, 2 Drawing Sheets

FIG. 2
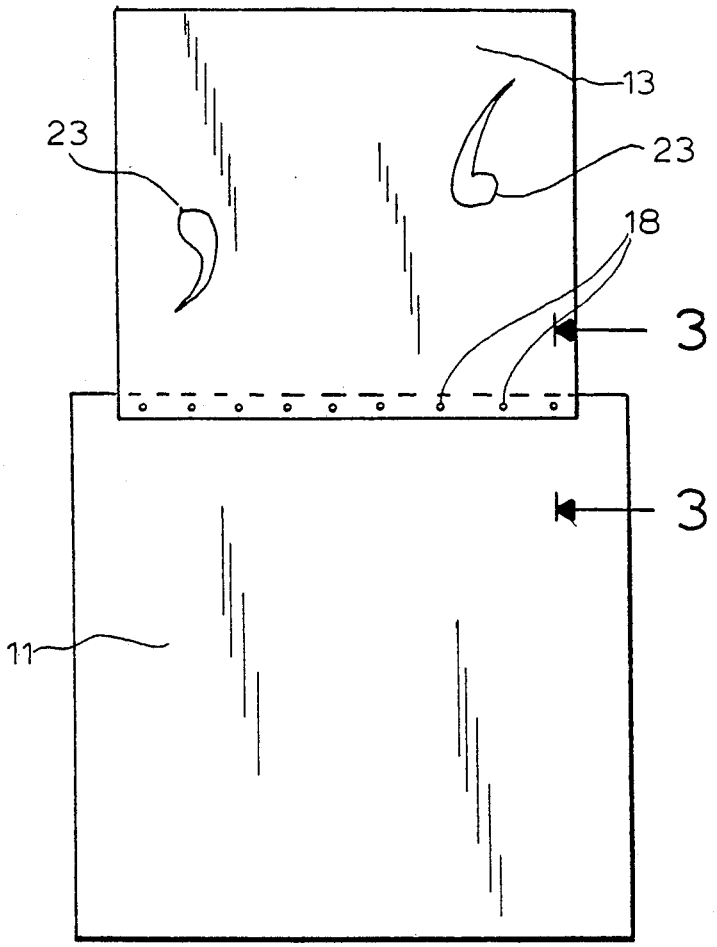
FIG. 3
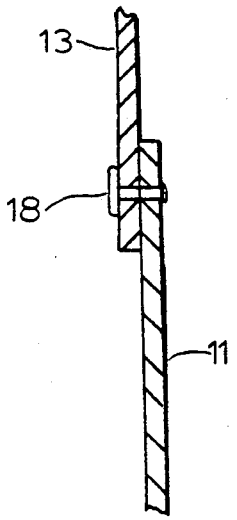
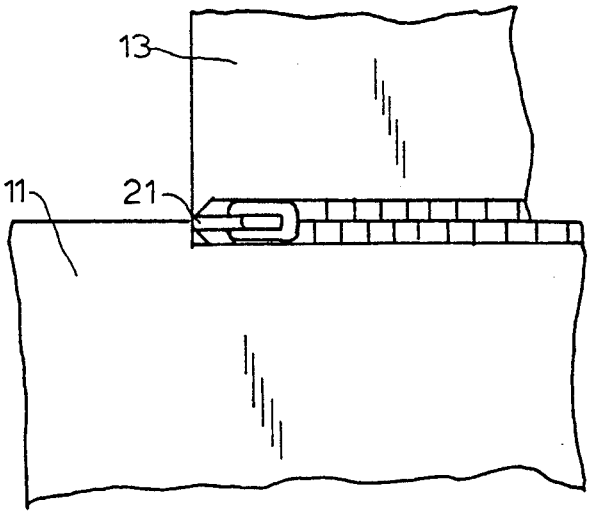
FIG. 4

DECORATIVE BED COVERING

BACKGROUND OF THE INVENTION

Various bed coverings are used on a made up bed including a sheet wrapped over a mattress, a blanket, an underliner sheet for the blanket so that the blanket does not touch the occupant of the bed, and a bedspread. Typically, when a bed is made up, particularly when no bedspread is used, the blanket underliner sheet extends from under the blanket, beyond the upper edge of the blanket, and is folded back over the blanket upper edge so that the entire underside of the blanket and the uppermost exterior side of the blanket are covered by the sheet.

In the foregoing condition, the appearance of the made up bed is affected by the visible portion of the underliner sheet that is folded over the upper portion of the blanket. In order to change the appearance of the made up bed insofar as it is affected by the appearance of the underliner, the entire underliner sheet must be changed even though only the folded over part is visible. This sometimes requires removal of a clean underliner sheet to change the appearance of the bed. Other times, it may be desirable to keep the appearance of the folded over portion of the underliner sheet, but necessary to replace the sheet for hygienic reasons. In the latter instance, unless an identical clean underliner sheet is available, the appearance of the bed must be changed when the sheet is changed.

SUMMARY OF THE INVENTION

The instant invention overcomes the aforementioned problems of the prior art in providing a bed covering of flexible cloth having first and second mutually connectable panels and respective complementary fastener mean for removably attaching said first panel to said second panel, e.g., buttons, snaps, a zipper or a self adhesive material. The second panel which is folded over the blanket may be of the same width as the first panel, or narrower or wider than the first panel.

DESCRIPTION OF THE DRAWINGS

FIG. 2 is a plan view of the apparatus of another preferred embodiment of the invention.

FIG. 3 is a fragmentary side sectional view of the apparatus of the preferred embodiment of the invention of FIG. 2.

FIG. 4 is a fragmentary plan view of the apparatus of still another preferred embodiment of the invention.

DESCRIPTION OF THE PREFERRED EMBODIMENTS

The invention will now described primarily with respect to an environment in which the it is used as a blanket underliner. Other applications for the invention will be briefly noted at the conclusion of this description.

Figure 1:
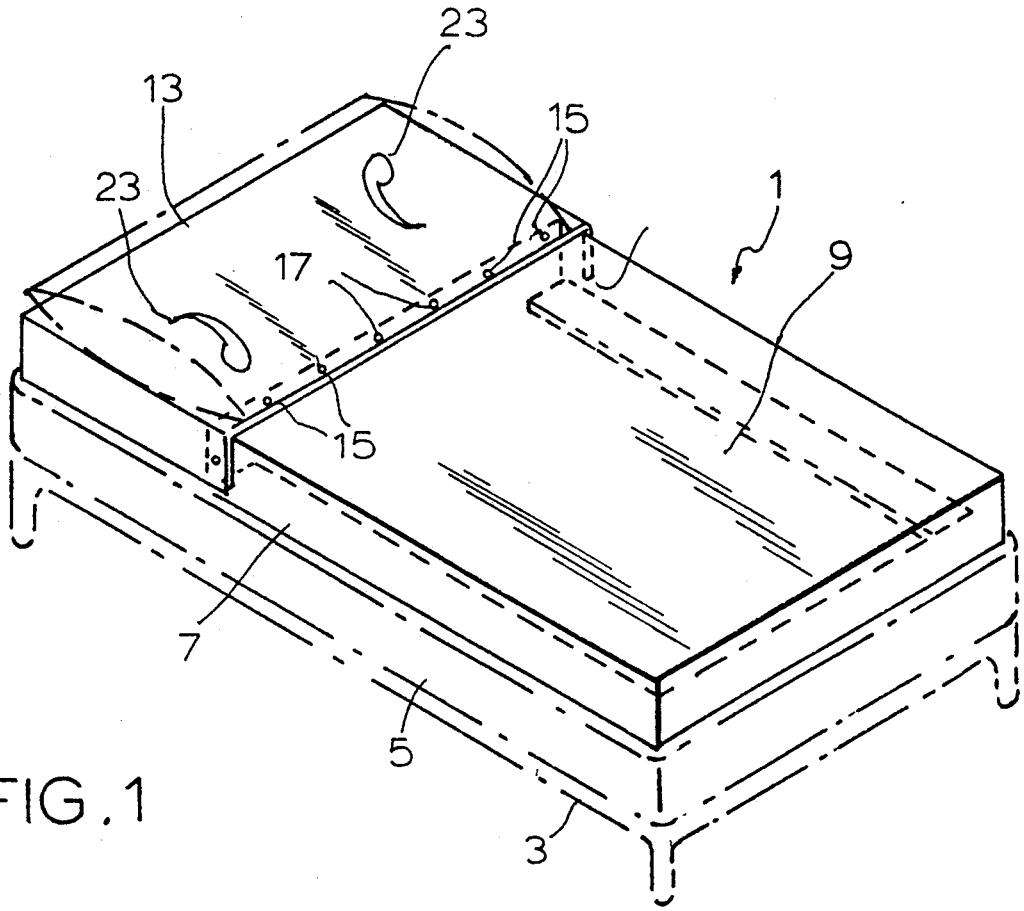
FIG. 1 is a perspective environmental view of the apparatus of a preferred embodiment of the invention.
Figure 5:
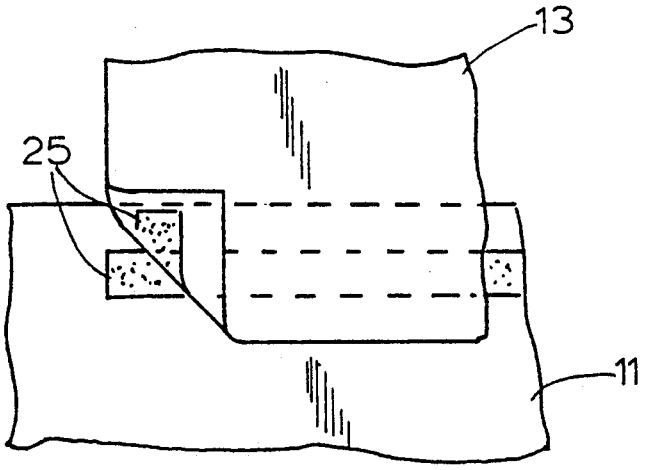
FIG. 5 is a fragmentary plan view of the apparatus of a further preferred embodiment of the invention.

Referring to the drawings, there is shown in FIG. 1, a bed 1 including a frame 3 upon which there is disposed a box spring 5 and a mattress 7. The mattress 7 is covered by a conventional bed sheet (not shown) that is tucked under the mattress 7 on all four of its sides. A rectangular blanket 9 slightly wider than the width plus twice the depth of the mattress 7 covers the mattress 7 with its sides tucked under the mattress 7.

Between the mattress 7 and the blanket 9 there is disposed a first or lower panel 11 of a two-panel bed covering adapted to serve as a blanket underliner. The lower panel 11 can be formed from a cloth fabric of the same type used for a conventional bed sheet. Sewn onto the top surface of an upper border of the lower panel 11 is a series of equally spaced conventional buttons 15.

A second or upper panel 13 has a series of equally spaced apertures in the form of button holes 17 in its lower border. The upper panel 13 overlaps the lower panel 11 at their respective lower and upper borders to form a contiguous underliner for the blanket 9. The upper panel 13 is preferably shorter than the lower panel.

The upper panel 13 can be made from the same material as the lower panel 11 or from a different material which may be more decorative. When the bed 1 is made up, only the upper panel 13 is visible as will be shown below.

The underliner is placed relative to the blanket 9 when the bed is made up so that the overlapping respective lower and upper borders of the upper panel 13 and lower panel 11 are beneath and hidden by the upper border of the blanket 9. A sufficient length of the remainder of the upper panel 13 extends beyond the upper border of the blanket 9 so that it can be folded back over the top surface of the blanket 9 with its bottom side then being visible as it faces in the same direction as the top side of the blanket 9 as shown in FIG. 1.

At least the bottom side of the upper panel 13 which becomes visible when folded over in a made up bed is desirably imprinted, embroidered, or otherwise decorated with an aesthetically pleasing design 23. The upper panel 13 is also of a color that need not, although it may, be the same color as the lower panel 11. The lower panel 11 or upper panel 13 of one bed covering can be exchanged with the lower panel 11 or upper panel 13 of another bed covering so that the bed 1 can be given an aesthetically pleasing appearance independently of the need to change the lower panel 11 for hygienic reasons.

The width of the upper panel 13 may be greater, equal to, or less than the width of the lower panel 11 depending on the desired visual effect. In the view of FIG. 1, the width of the upper panel 13 is sufficient to cover the sides of the mattress 7.

The lower panel 11 and upper panel 13 may be attached by devices other than buttons and button holes 17. For example, as seen in FIGS. 2 and 3 conventional snaps 18 can be installed in the overlapping borders of the lower panel 11 and upper panel 13 so that the lower panel 11 and upper panel 13 can be selectively connected and separated.

In FIG. 4, there is shown a zipper 21 which can have its components sewn onto the respective upper and lower edges of the lower panel 11 and upper panel 13 for removably attaching them.

In FIG. 4, there is shown a highly preferred fastener device for attaching the lower panel 11 and upper panel 13 which is formed by sewing onto the facing sides of the overlapping borders of the lower panel 11 and upper panel 13, a strip of a self adhering material 25 such as is sold under the name Velcro.

It is to be appreciated that the foregoing is a description of several preferred embodiments of the invention to which variations and modifications may, be made without departing from the spirit and scope of the invention. For example, other releasable fastening devices may be used to connect the lower panel 11 and upper panel 13. The lower panel 11 and upper panel 13 can be fabricated not only from various cloth materials but from synthetics or other materials having the flexible characteristics of cloth materials.

Moreover, the bed covering of the invention need not be used as a blanket underliner at all. In fact it can serve as a blanket having the false appearance of a sheet underliner folded back over a blanket. This can be done by selecting a suitable "blanket material" for the first panel and a "sheet material" for the second panel, the two being removably fastened together, with the second panel folded back over the first panel. In this case, the first panel and the second are both visible when the bed is made up. Depending on the selection of materials and designs for the first and second panels, various arrangements, including facades, can be achieved by utilizing the structure of the invention.

What is claimed is:

1. A bed covering having an upper end and a lower end, said bed covering comprising a flexible cloth having first and second mutually connectable panels and respective complementary fastener means for removably attaching said first panel to said second panel, and a blanket, each of said panels and said blanket having both an upper end and a lower end, the upper end of said second panel being the upper end of said bed covering and the lower end of said first panel being the lower end of said bed covering, the upper end of said second panel folded back so that said second panel covers said complementary fastener means, the upper end of said blanket being disposed between said first and second panels whereby the upper end of said second panel is exposed, and said complementary fastener means and at least the upper end of said first panel and the upper end of said blanket are covered.

2. A bed covering according to claim 1 wherein said first panel fastener means is disposed at said first panel upper end and said second panel fastener means is disposed at said second panel lower end.

3. A bed covering according to claim 2 wherein one of said first and second panel fastener means comprises a plurality of button means and the other of said first and second panel fastener means comprises a region of said end of said other panel having apertures in one-to-one spaced correspondence with said button means whereby said first and second panels are removably connected by inserting said buttons means in said corresponding apertures.

4. A bed covering according to claim 2 wherein each of said first and second panel fastener means comprises a separable self-adhering material.

5. A bed covering according to claim 2 wherein said first and second panel fastener means comprise a plurality of snap fastener means in one-to-one spaced correspondence whereby said first and second panels are removably connected by interconnecting said snap fastener means.

6. A bed covering according to claim 2 wherein said first and second panel fastener means comprise complementary zipper means whereby said first and second panels are removably connected by interconnecting said zipper means.

7. A bed covering according to claim 2 wherein said first panel is longer than said second panel.

8. A bed covering according to claim 2 wherein said second panel is narrower than said first panel.

9. A bed covering according to claim 2 wherein said second panel is wider than said first panel.

10. A bed covering according to claim 2 wherein said first and second panels one of equal width.

11. A bed covering according to claim 1 wherein the surface of said first panel has an appearance different from the surface of said second panel.

* * * * *

UNITED STATES PATENT AND TRADEMARK OFFICE

CERTIFICATE OF CORRECTION

PATENT NO. : 5,118,553

DATED : JUNE 2, 1992

INVENTOR(S) : BOISSON

It is certified that error appears in the above-identified patent and that said Letters Patent is hereby corrected as shown below:

In claim 10, at column 4, line 37, change "one" to --are--.

Signed and Sealed this

Twentieth Day of July, 1993

*Attest:*

Michael K. Kirk

MICHAEL K. KIRK

*Attesting Officer*

*Acting Commissioner of Patents and Trademarks*